US011214424B2

(12) United States Patent
Campos et al.

(10) Patent No.: US 11,214,424 B2
(45) Date of Patent: Jan. 4, 2022

(54) PACKAGING SYSTEM AND CONTAINER

(71) Applicants: Joyson Safety Systems Acquisition LLC, Auburn Hills, MI (US); ASC Packaging Inc., Laredo, TX (US)

(72) Inventors: Carlos Campos, Coahuila (MX); Cesar Muzquiz, Coahuila (MX); Eduardo Arroyo, Laredo, TX (US); Jason Newell, Ontario (CA)

(73) Assignees: JOYSON SAFETY SYSTEMS ACQUISITION LLC, Auburn Hills, MI (US); ASC PACKAGING INC., Laredo, TX (US)

( * ) Notice: Subject to any disclaimer, the term of this patent is extended or adjusted under 35 U.S.C. 154(b) by 10 days.

(21) Appl. No.: 16/662,366

(22) Filed: Oct. 24, 2019

(65) Prior Publication Data

US 2021/0122552 A1 Apr. 29, 2021

(51) Int. Cl.

*B65D 77/04* (2006.01)
*B65D 85/68* (2006.01)
*B65D 5/44* (2006.01)

(52) U.S. Cl.

CPC ..... *B65D 77/042* (2013.01); *B65D 5/448* (2013.01); *B65D 85/68* (2013.01); *B65D 2585/6882* (2013.01)

(58) Field of Classification Search

CPC ..... B65D 5/44; B65D 5/448; B65D 77/04; B65D 77/042; B65D 85/68; B65D 2585/6882; B65D 85/48; B65D 85/00

See application file for complete search history.

(56) References Cited

U.S. PATENT DOCUMENTS

| | | | | | |
|---|---|---|---|---|---|
| 3,128,811 | A * | 4/1964 | Higgins | B65D 37/00 | 229/199 |
| 3,372,855 | A * | 3/1968 | Smith | B65D 19/06 | 229/199 |
| 3,782,619 | A * | 1/1974 | Dittbenner | B65D 5/321 | 206/577 |
| 4,793,550 | A * | 12/1988 | Gottlieb | B65D 5/441 | 229/199 |
| 4,865,200 | A * | 9/1989 | Sullivan | B65D 5/5035 | 206/583 |
| 5,351,849 | A * | 10/1994 | Jagenburg | B65D 77/061 | 229/199 |
| 8,910,854 | B2 * | 12/2014 | Southwell | B65D 5/029 | 229/199 |
| 8,991,684 | B2 * | 3/2015 | Mengistu | B65D 88/522 | 229/199 |
| 10,308,395 | B2 * | 6/2019 | Zhang | B65D 5/0005 | |
| 2004/0074798 | A1 * | 4/2004 | Taylor | B65D 75/14 | 206/455 |

* cited by examiner

*Primary Examiner* — Bryon P Gehman
(74) *Attorney, Agent, or Firm* — Gordon Rees Scully Mansukhani, LLP

(57) ABSTRACT

A container that includes an inner receptacle and outer carton. The inner receptacle includes a plurality of reinforcement straps. The reinforcement straps are attached to the inner receptacle and configured to absorb energy from a deployment of a vehicle safety device such as an airbag module. The reinforcement straps may be placed in a cross or parallel configuration.

18 Claims, 6 Drawing Sheets

PACKAGING SYSTEM AND CONTAINER

GENERAL DESCRIPTION

The present disclosure relates to a packaging system and container. In particular an energy absorbing container enabling a low cost method to package hazardous equipment easily and safely.

Automotive safety devices are required to be tested according to the United Nations manual of Test and Criteria Test Series 6(c) by the United States Department of Transportation (USDOT), International Air Transport Association (IATA), International Maritime Dangerous Goods, European Agreement concerning the International Carriage of Dangerous Goods by Road (ADR), and other international or regional authority agencies. The automotive industry prefers Class 9, UN3268 hazmat classification as it allows for less restrictive transportation, storage and handling requirements and provides additional transportation modes.

To obtain Class 9, the automotive safety devices being transported are required to pass the distance requirement while performing the UN Series 6(c) test which can be difficult on products such as air bag modules. The UN Series 6(c) test is performed by igniting wood placed under the automotive safety devices (e.g. airbag modules, pretensioners). During the test, the safety device may be oriented bag down and the energy from the deployment of the module, caused, in one example, by temperature sensitive, auto-igniting propellants within the module, may allow the module to travel greater than what is allowed by the regulations to obtain Class 9. As automotive safety devices continue to be more compact and lighter, this test continues to be difficult to pass using standard fiberboard boxes. More expensive and heavier packaging is required to help maintain the desired Class 9 approval.

Current packaging used in the automotive safety device industry includes UN 4G Fiberboard boxes and 4H plastic boxes. When providing safety devices for new vehicles, the global safety device manufacturer is required to provide the automobile manufacturer with service boxes containing only one safety device. The current packaging options includes steel wire impregnated cardboard, steel cages, wiring parts with additional weight, and wiring parts together. These features are expensive, unsafe, and can weigh more than five times the standard fiberboard boxes. The current packaging options increase transport costs and are not worker friendly during assembly.

Accordingly, an object of the present disclosure is to provide a low cost, lightweight, recyclable container for a standard fiberboard, plastic or similar light weight packaging that assists in the distance requirement of the UN Series 6(c) test.

BRIEF DESCRIPTION OF THE DRAWINGS

The features, aspects, and advantages of the present disclosure will become apparent from the following description, and the accompanying exemplary embodiments shown in the drawings, which are briefly described below.

DETAILED DESCRIPTION

According to one embodiment of the disclosure, reinforcement straps enclose an automotive safety device to absorb the energy during deployment on the UN Series 6(c) bonfire to help maintain the parts within the distance requirement of the UN Series 6(c) test. The straps are applied outside the protective inner receptacle to prevent the straps from causing physical (e.g. cosmetic) damage. The strapped inner receptacle is then assembled into standard packaging (e.g., a container). In one exemplary embodiment the inner receptacle includes reinforcement straps in a cross or x-shaped configuration. In the cross configuration, the straps may include an interior reinforcement strap and exterior reinforcement strap. The interior reinforcement strap being smaller that the exterior reinforcement strap such that the interior reinforcement strap sits inside the exterior reinforcement strap to create the cross configuration. The inner receptacle may also include tabs to hold the reinforcement straps onto itself in the cross configuration.

In another embodiment, reinforcement straps are disposed parallel and coaxial relative to the longitudinal axis of the inner receptacle. The reinforcement straps are embedded within the inner receptacle. The inner receptacle includes an interior wall and an exterior wall. The reinforcement straps in the parallel configuration surround the interior wall of the inner receptacle. This configuration allows packaging of larger safety devices such as passenger side airbags.

Figure 1:
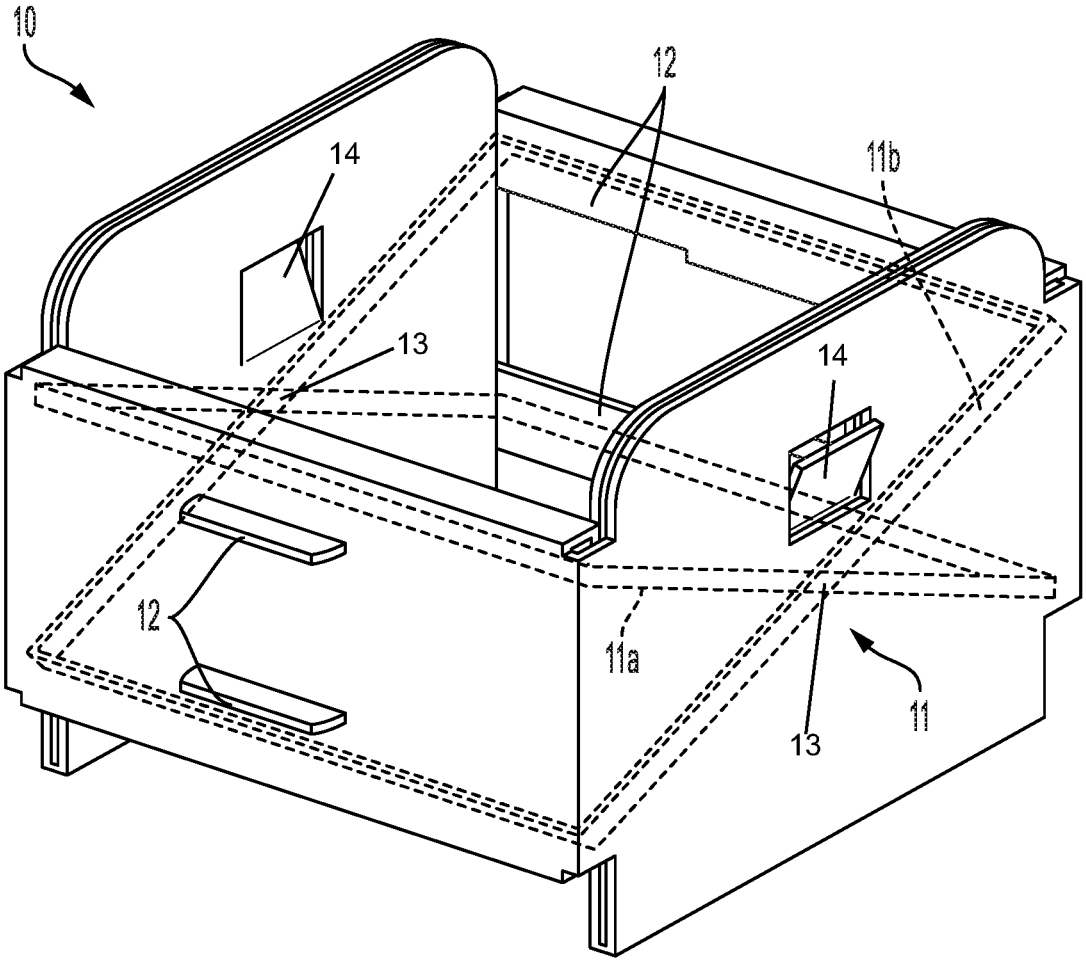
FIG. 1 is an inner receptacle of an exemplary container.

FIG. 1 discloses an inner receptacle 10, with reinforcement straps 11. The inner receptacle 10 may be foldable. The inner receptacle 10 may include flaps 14 that secure the foldable portions of the inner receptacle together. The reinforcement straps 11 are held onto the inner receptacle with foldable tabs 12. The reinforcement straps 11 are configured to absorb energy from the deployment of the safety device during the UN Series 6(c) test. The reinforcement straps 11 may be made of metal or similar flame resistance materials such as steel chains, fire resistant or fire retardant webbing, wire rope slings, flexible grounding braid, etc. While multiple reinforcement straps 11 are shown in the figures, the inner receptacle may include only one reinforcement strap 11.

Figure 2:
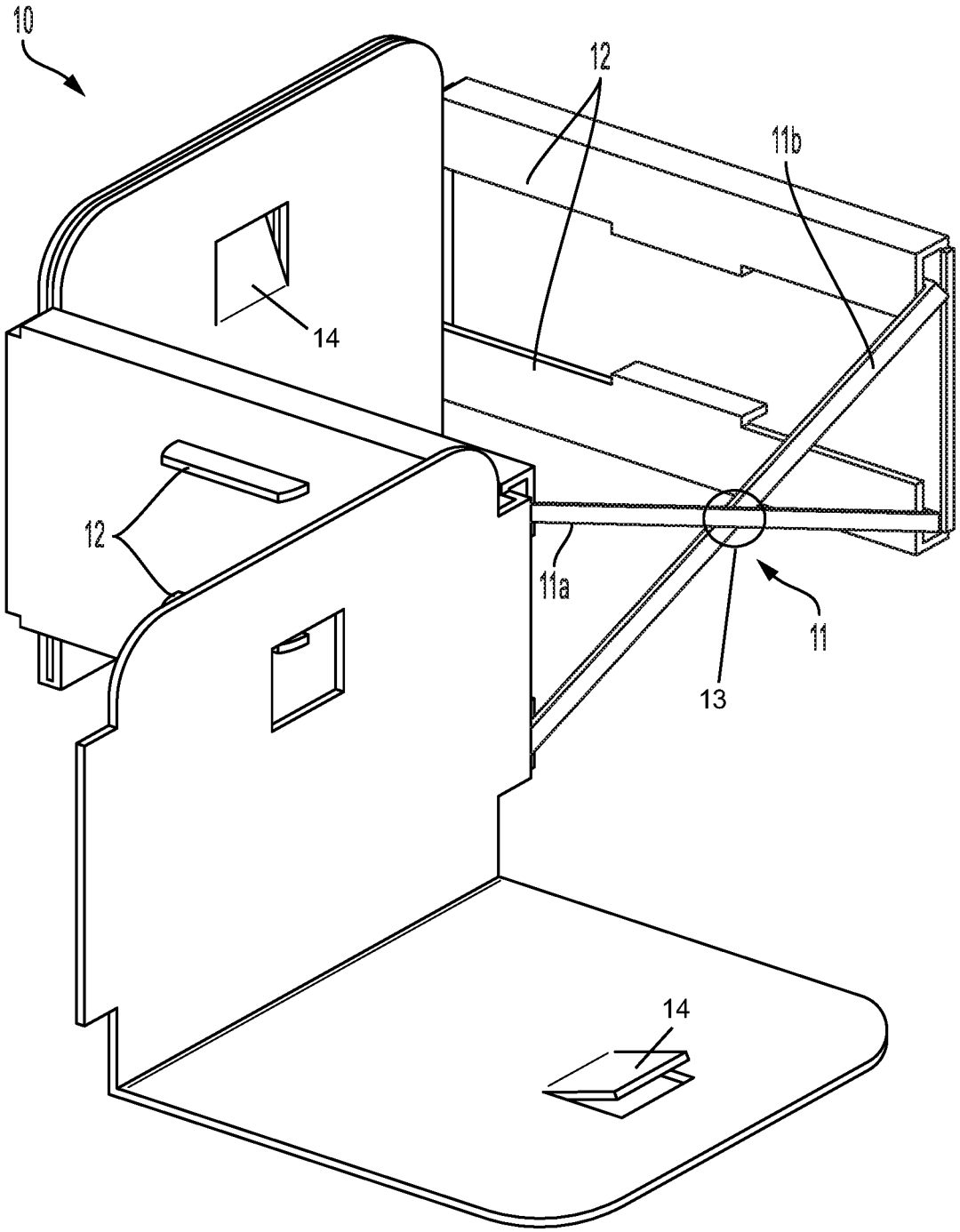
FIG. 2 is an inner receptacle of an exemplary container.

FIG. 2 discloses an inner receptacle 10, with exposed reinforcement straps 11. The reinforcement straps 11 shown include an outer reinforcement strap 11*a* and an inner reinforcement strap 11*b*. The inner reinforcement strap 11*b* is placed inside the outer reinforcement strap 11*a* to allow a cross configuration as shown. The cross configuration of the reinforcement straps may be wherein a face at an end of a reinforcement strap is angled relative to an end of another reinforcement strap such that a projection of the face of the reinforcement strap intersects a projection of the face of the other strap. The cross configuration can also may be wherein at least one reinforcement strap crosses over another reinforcement strap such that an x shape is formed. The inner reinforcement strap 11*b* may be manufactured slightly smaller than the outer reinforcement strap 11*a* in the longitudinal direction so that the inner strap 11*b* may be placed in the cross configuration relative to the outer strap 11*a*. Both outer and inner straps 11*a*/11*b* may also be flexible enough to accommodate each other such that the outer and inner straps 11*a*/11*b* may be manufactured with the same dimensions.

Figure 3:
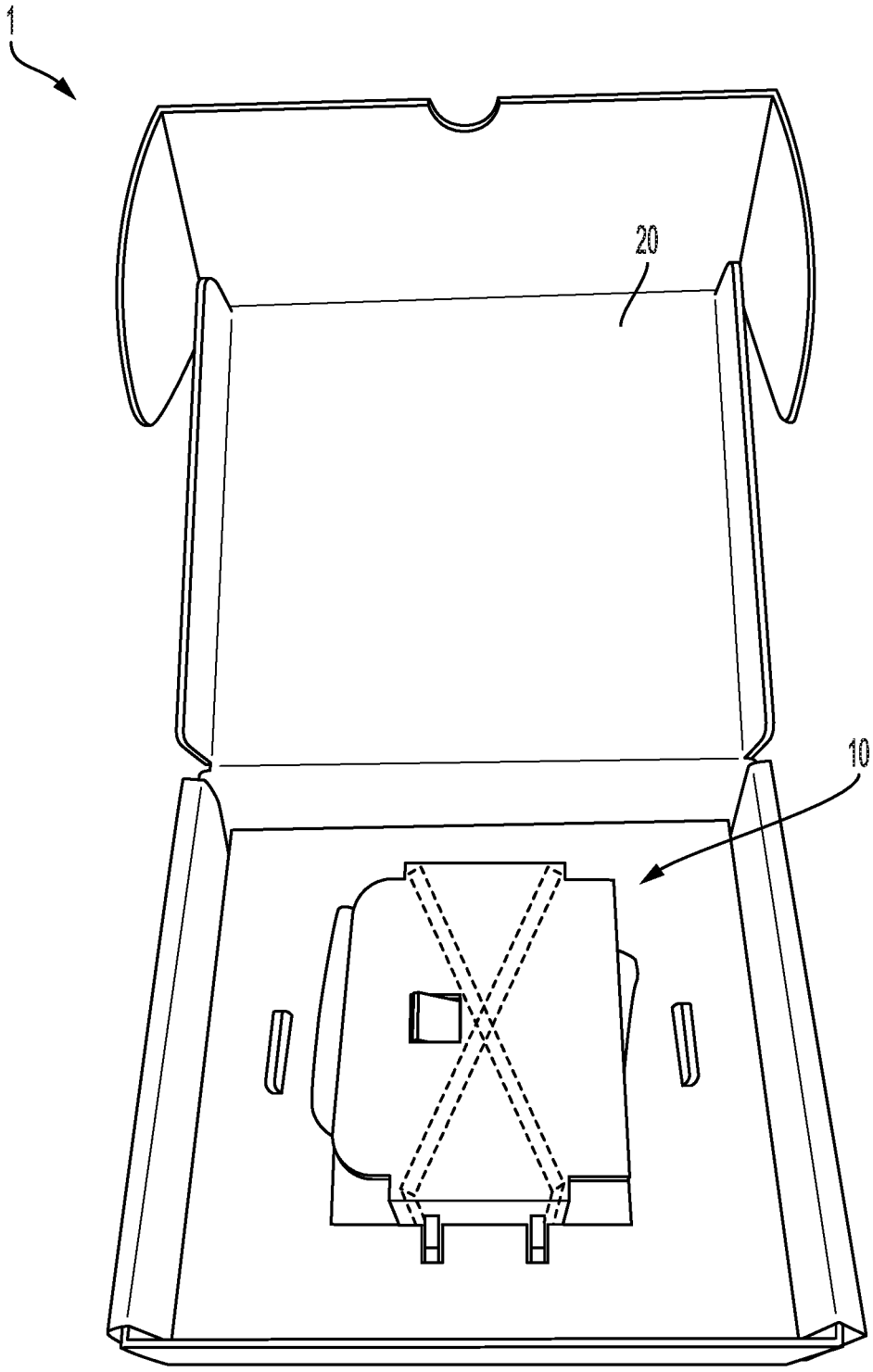
FIG. 3 is an exemplary container.

FIG. 3 discloses a container 1 with an inner receptacle 10 with an outer carton 20. The outer carton 20, may contain a recess for the inner receptacle 10 to fit in. The inner receptacle 10 is configured to hold an airbag module (not shown). The airbag module may be positioned such that the metal frames restrict the expansion of the cushion during the deployment of the airbag module. This position may have the front face of the airbag module, or any direction in which the cushion is configured to deploy relative to the airbag module, face the cross 13 of the cross configuration of the reinforcement straps 11. The inner receptacle 10 may be placed such that the cross 13 of the reinforcement straps are placed such that the cross faces the opening of the outer carton 20. The inner receptacle and outer carton may be made of standard fiberboard, plastic or similar light weight packaging.

Figure 4:
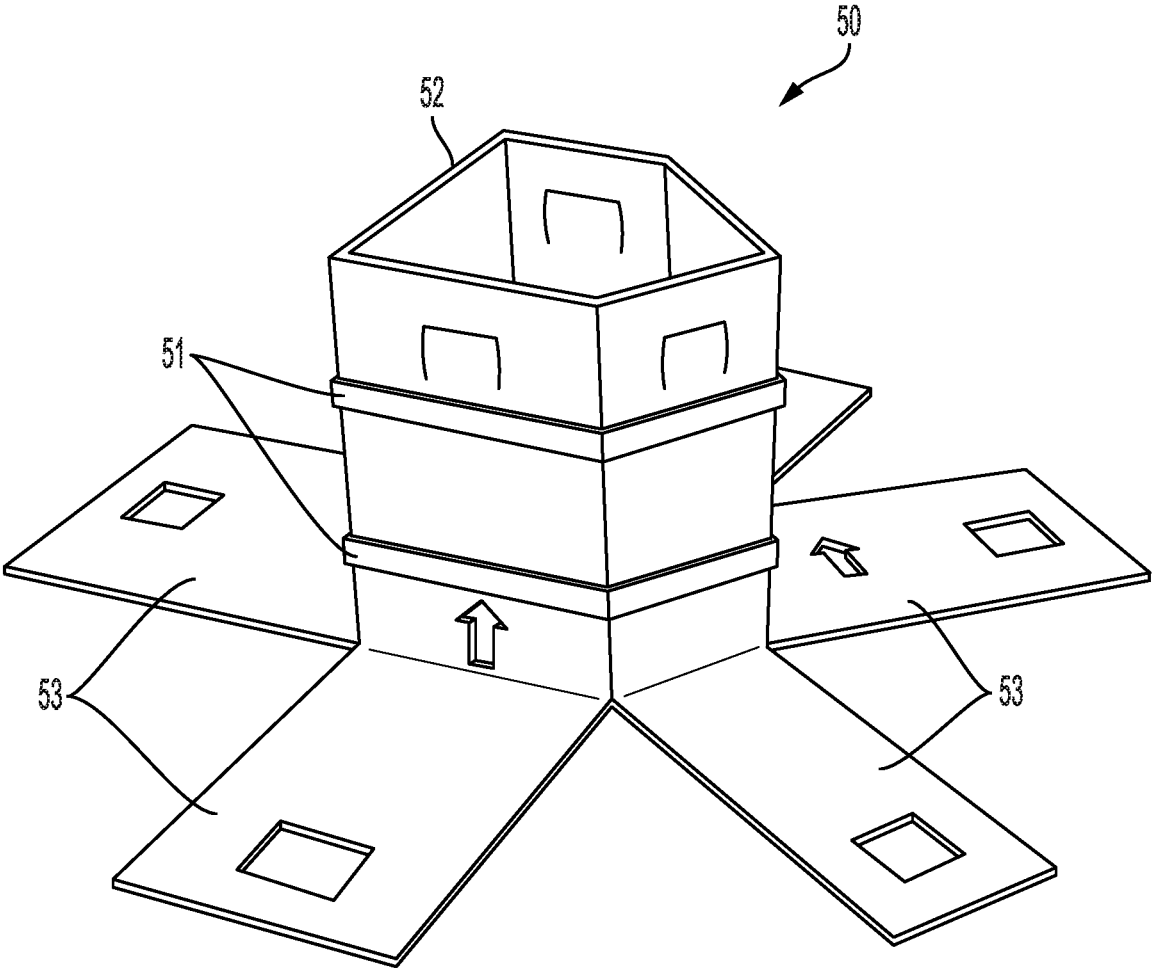
FIG. 4 is an inner receptacle of another exemplary container.
Figure 5:
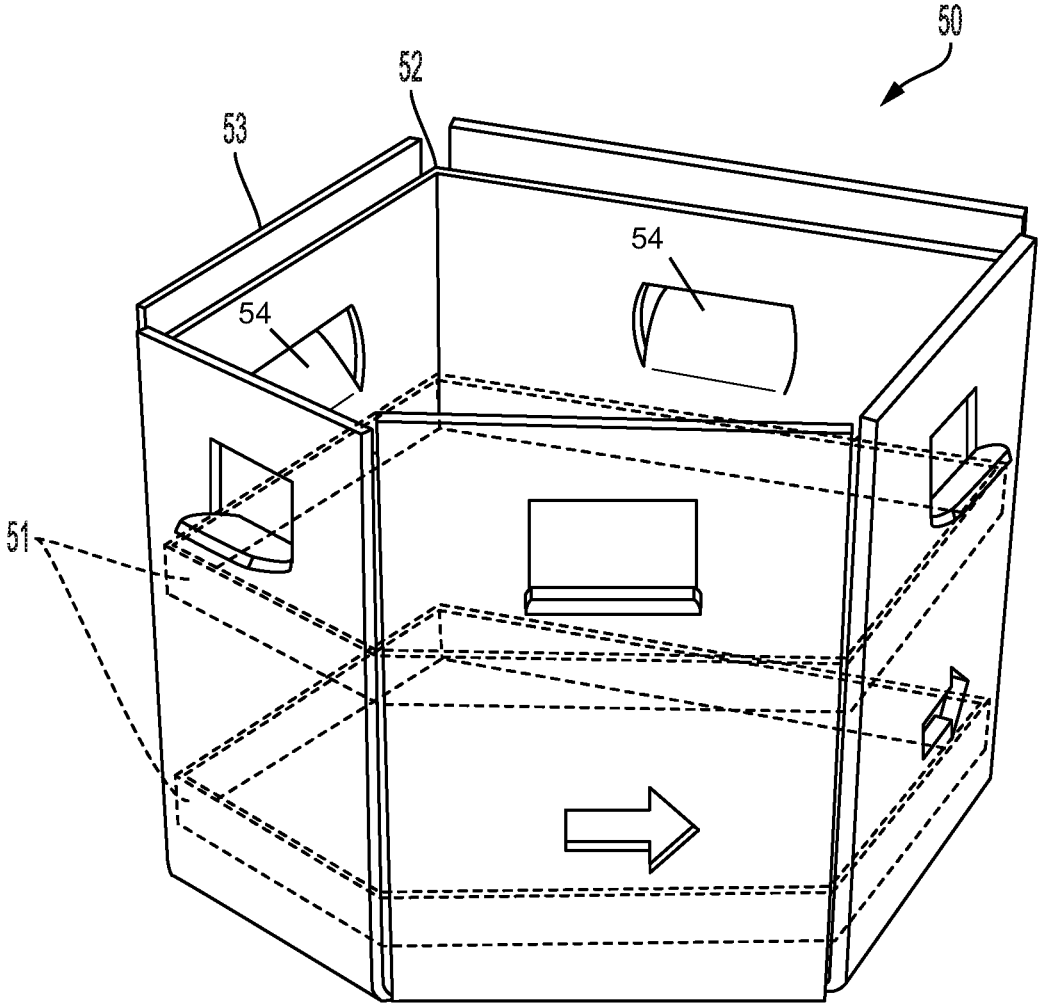
FIG. 5 is an inner receptacle of another exemplary container.

FIGS. 4 and 5 disclose another exemplary embodiment of an inner receptacle 50 with parallel reinforcement straps 51. In this embodiment, the packaging system is configured to hold larger safety systems such as a passenger airbag module. The reinforcement straps 51 are embedded between an inner receptacle interior wall 52 and inner receptacle exterior wall 53. The reinforcement straps 51 surround the perimeter of the interior wall 52 with the exterior wall 53 being foldable and surrounding the reinforcement straps 51. The inner receptacle 50 may include flaps 54 for securing foldable portions of the inner receptacle together.

Figure 6:
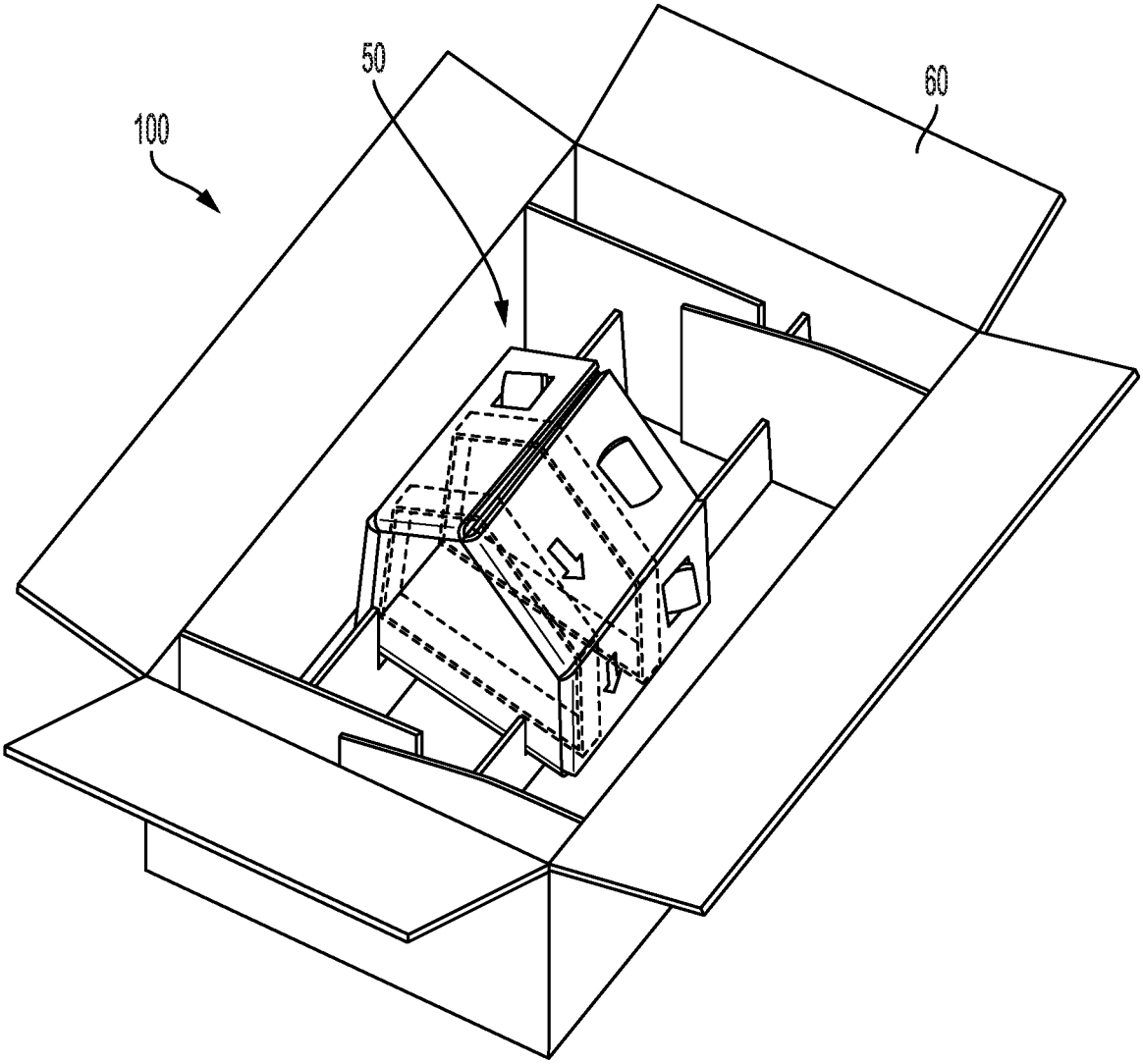
FIG. 6 is another exemplary container.

FIG. 6 discloses the container 100 with the inner receptacle 50 placed inside outer carton 60. An airbag module may be placed inside inner receptacle 50. The inner receptacle 50 may be orientated in the outer carton 60 such that the reinforcement straps 51 are laid across the outer carton 60. However, other orientations of the inner receptacle 50 relative to the outer carton 60 that allow optimal absorption of the energy of the deployment of the safety device (i.e. airbag module) are also possible. The inner receptacle and outer carton may be made of standard fiberboard, plastic or similar light weight packaging.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the airbag module packaging as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A container for transporting an automotive airbag module including an inflatable cushion and an inflator, the container comprising:

an outer carton configured to hold an inner receptacle, and wherein the inner receptacle is positioned to surround the airbag module;

a plurality of reinforcement straps attached to the inner receptacle, wherein at least one reinforcement strap of the plurality of reinforcement straps crosses over with one other reinforcement strap of the plurality of reinforcement straps; and wherein the inner receptacle includes foldable portions and wherein one of the foldable portions includes a flap positioned to secure the foldable portions together, and wherein the at least one reinforcement strap is embedded between the foldable portions.

2. The container of claim 1, wherein each of the plurality of reinforcement straps comprises metal.

3. The container of claim 1, wherein the flap of the inner receptacle is configured to be inserted through a wall of the inner receptacle.

4. The container of claim 3, wherein the inner receptacle comprises fiberboard.

5. The container of claim 3, wherein the outer carton comprises fiberboard.

6. The container of claim 1, wherein the plurality of reinforcement straps comprises an X shape.

7. A container for holding an airbag module comprising:

an inner receptacle surrounding the airbag module, and wherein the inner receptacle is located within an outer carton;

a reinforcement strap configured to absorb energy from a deployment of the airbag module, wherein the reinforcement strap is attached to the inner receptacle; and wherein the inner receptacle includes an inner wall and an outer wall, and wherein the inner wall and outer wall are connected and fold so that a segment of the reinforcement strap is embedded between the inner wall and the outer wall.

8. The container of claim 7, further comprising a plurality of reinforcement straps.

9. The container of claim 8, wherein at least one reinforcement strap of the plurality of reinforcement straps crosses over with one other reinforcement strap of the plurality of reinforcement straps.

10. The container of claim 8, wherein at least one reinforcement strap of the plurality of reinforcement straps is parallel with one other reinforcement strap of the plurality of reinforcement straps.

11. The container of claim 8, wherein each of the plurality of reinforcement straps comprises metal.

12. The container of claim 7, wherein the inner receptacle is made of fiberboard.

13. The container of claim 7, wherein the outer carton is made of fiberboard.

14. A container for transporting an automotive airbag module including an inflatable cushion and an inflator, the container comprising:

an outer carton configured to hold an inner receptacle positioned to surround the airbag module;

a plurality of reinforcement straps attached to the inner receptacle, wherein at least one reinforcement strap of the plurality of reinforcement straps crosses over with one other reinforcement strap of the plurality of reinforcement straps;

wherein the inner receptacle comprises a foldable tab that folds over the at least one of the reinforcement straps so that the at least one of the reinforcement straps is embedded between a wall of the inner receptacle and the foldable tab such that the foldable tab holds the reinforcement strap onto the inner receptacle.

15. The container of claim 14, wherein the foldable tab of the inner receptacle is configured to be inserted through the wall of the inner receptacle.

16. The container of claim 15, wherein the inner receptacle comprises fiberboard.

17. The container of claim 15, wherein the outer carton comprises fiberboard.

18. The container of claim 14, wherein the plurality of reinforcement straps comprises an X shape.

* * * * *